US005620769A

United States Patent [19]

Wessels et al.

[11] Patent Number: 5,620,769

[45] Date of Patent: Apr. 15, 1997

[54] MOLDED SURFACE FASTENER AND METHOD FOR MANUFACTURING THE SAME

[75] Inventors: Roger T. Wessels; Piljae Cho, both of Macon, Ga.

[73] Assignee: YKK Corporation, Tokyo, Japan

[21] Appl. No.: 433,200

[22] Filed: May 2, 1995

[51] Int. Cl.[6] ..... A44B 18/00; B29C 47/02

[52] U.S. Cl. ..... 428/100; 428/120; 24/442; 24/444; 24/445; 24/452; 156/244.15; 264/136; 264/167; 264/171.13; 264/173.1; 264/177.19; 264/328.8; 264/257; 425/115; 425/327

[58] Field of Search ..... 264/167, 166, 264/173.1, 171.13, 178 R, 177.19, 136, 328.8, 257; 425/327, 115, 325; 428/100, 120; 156/244.12, 66, 244.27, 244.25, 244.15; 29/442, 444, 445, 452

[56] References Cited

U.S. PATENT DOCUMENTS

| | | | |
|---|---|---|---|
| 3,168,605 | 2/1965 | Ellegast et al. . | |
| 3,230,134 | 1/1966 | Studer | 156/244.25 |
| 3,399,425 | 9/1968 | Lemelson | 425/327 |
| 3,594,863 | 7/1971 | Erb | 425/327 |
| 3,594,865 | 7/1971 | Erb | 425/115 |
| 3,608,035 | 9/1971 | Fröhlich | 264/166 |
| 3,758,657 | 9/1973 | Menzin et al. | 264/167 |
| 4,001,366 | 1/1977 | Brumlik | 264/177.1 |
| 4,769,202 | 9/1988 | Eroskey et al. . | |
| 4,931,344 | 6/1990 | Ogawa et al. | 428/100 |
| 4,999,067 | 3/1991 | Erb et al. | 156/244.25 |
| 5,260,015 | 11/1993 | Kennedy et al. | 264/167 |
| 5,393,475 | 2/1995 | Murasaki et al. | 264/167 |
| 5,441,687 | 8/1995 | Murasaki et al. | 264/167 |
| 5,512,234 | 4/1996 | Takizawa et al. | 264/167 |

*Primary Examiner*—Jeffery R. Thurlow
*Attorney, Agent, or Firm*—Hill, Steadman & Simpson

[57] ABSTRACT

In a molded surface fastener manufacturing method, molten resin is injected or extruded from an injection die or an extrusion nozzle, and at the same time, a coarse mesh core sheet is introduced between the extruded molten resin and the circumferential surface of a die wheel, which has a multiplicity of hook-element-forming circumferential cavities. The core sheet is forced against the circumferential surface of the die wheel by a pressing force of a press roller or under a molten resin pressure at the time of injection to pass part of the molten resin through pores of the core sheet and to fill in the hook-element-forming cavities. As a result, a multiplicity of hook elements are molded, and at the same time, the core sheet is embedded integrally in a plate-shaped substrate sheet closer to the hook-element-surface side.

11 Claims, 3 Drawing Sheets

MOLDED SURFACE FASTENER AND METHOD FOR MANUFACTURING THE SAME

BACKGROUND OF THE INVENTION

1. Field of the Invention

This invention relates to a surface fastener molded of thermoplastic resin and having a plate-like substrate sheet and a multiplicity of engaging elements standing on a surface of the plate-like substrate sheet and a method for continuously molding the surface fastener by extrusion using thermoplastic resin. More particularly, the invention relates to a surface fastener in which a coarse mesh sheet is embedded in the plate-like substrate sheet and a method for manufacturing the surface fastener.

2. Description of the Related Art

In manufacturing a surface fastener, the technology of molding a plate-like substrate sheet and a multiplicity of engaging elements standing on one surface of the plate-like substrate sheet by extrusion and attaching a core sheet to the plate-like substrate sheet during the molding is disclosed in, for example, U.S. Pat. No. 5,260,015. According to the concept disclosed in this U.S. Patent, molten thermo-plastic resin is extruded to a gap between a rotating drum-shape die wheel, in which a multiplicity of mold disks and a multiplicity of spacer plates are laminated alternately, and a press roller, and the core sheet is introduced between the extruded resin and the press roller. As the core sheet is thus introduced, part of the resin is penetrated into the core sheet by the pressing force of the press roller to integrate with the substrate sheet and, at the same time, part of the resin is filled in hook-element-forming peripheral cavities of the die wheel to mold a multiplicity of hook elements. The resulting surface fastener, in which the core sheet is integrally attached to the substrate sheet at its back surface opposite to the engaging surface, is cooled while traveling through a predetermined angle along the circumferential surface of the die wheel following the rotation of the die wheel, whereupon the molded hook elements are pulled out of the cavities and, at the same time, the substrate sheet is continuously peeled off the circumferential surface of the die wheel.

A continuous injection molding method for continuously manufacturing a surface fastener in which yarns are embedded in a plate-like substrate sheet is disclosed in copending U.S. patent application, Ser. No. 08/359,895 now U.S. Pat. No. 5,571,467. The molding method disclosed in this copending U.S. Application comprises continuously injecting molten resin from an injection die by a predetermined width onto the circumferential surface of a die wheel, which faces the injection die with a predetermined gap and has a multiplicity of hook-element-forming peripheral cavities and a built-in cooler, continuously introducing a plurality of fiber yarns in the direction of rotation of the die wheel across a molten resin outlet of the die wheel and one or more of the fiber yarns traverse by a predetermined width in parallel to the axis of the die wheel, filling the hook-element-forming cavities with part of the molten resin, while rotating the die wheel in the molten resin extruding direction, to embed the yarns in the plate-like substrate sheet to mold a multiplicity of hook elements on the surface of the plate-like substrate sheet, revolving the molded surface fastener through a predetermined angle along the circumferential surface of the die wheel following the rotation of the die wheel, and taking up the hook elements together with the plate-like substrate sheet by positively peeling them off.

In the surface fastener obtained by the manufacturing method disclosed in the above-mentioned U.S. Patent, as is apparent from the object, in an effort to overcome the conventional problem that the conventional type molded surface fastener has a smooth flat back surface so that an adhesive, a cement or the like is difficult to coat over the back surface until the back surface is treated with a special surface treatment, the core sheet is integrally attached to the back surface of the surface fastener to facilitate coating of the adhesive over the back surface and to form a multiplicity of piles or loops as female engaging elements on the back surface. In the resulting surface fastener, the core sheet exists in the plate-like substrate sheet eccentrically to the back-surface side, and part or majority of the plate-like substrate sheet comes out on the back surface.

According to the manufacturing method disclosed in the above-mentioned U.S. Patent, the surface fastener in which the core sheet is embedded in the plate-like substrate sheet eccentrically to the back-surface side is revolved through a predetermined angle along the circumferential surface of the die wheel in one-way rotation and is then positively peeled off the circumferential surface of the die wheel under a predetermined tension. In the case of the substrate-sheet-free surface fastener, since the hook elements molded in the hook-element-forming peripheral cavities of the die wheel have to be positively removed, the plate-like substrate sheet is expanded as a relatively great pulling force is exerted on the plate-like substrate sheet, apart from any deformation of the hook elements.

In the surface fastener manufactured by the method disclosed in the above-mentioned U.S. Patent, since the core sheet is embedded in the substrate sheet eccentrically to the back-surface side with synthetic resin impregnated in part of the core sheet, the back-surface side of the substrate sheet increases its rigidness and, at the same time, becomes less deformable against a pulling force. When the surface fastener molded on the circumferential surface of the die wheel is positively peeled off the circumferential surface as conventional, the substrate sheet is less extendible at the back-surface side, where the core sheet exists, and is more extendible at the front-surface side, where the hook elements exist. Therefore, after completion of the molding, the surface fastener has different lengths at the front and back sides so that the surface fastener is curved convexly at the hook-element side and it is difficult to control the coefficient of extension of the front-surface side, thus resulting in a non-uniform density of hook elements. In use, it is not only inconvenient when such surface fastener is attached to object goods, and a constant engagement strength cannot be achieved to impair the quality of product.

On the other hand, in the surface fastener molded according to the above-mentioned U.S. Patent Application, although it is enough to merely adjust the tension of yarns to be introduced straightly onto the circumferential surface of the die wheel, a traversing mechanism is required to traverse the yarns while being introduced onto the circumferential surface of the die wheel, and it is necessary to control the tension and the traverse width of the yarns with high precision, which makes the manufacturing apparatus complicated to increase the cost of production.

SUMMARY OF THE INVENTION

With the foregoing problems in view, it is a first object of this invention to provide a high-quality surface fastener which is stable in shape as extrusion or injection molded using a simple molding apparatus without any design change.

A second object of the invention is to secure an adequate degree of toughness of the hook-element side of a plate-like substrate sheet of the surface fastener and to realize a highly precise density of hook elements.

The above and other objects of the invention will be apparent from the following preferred embodiments.

As is described in the above-mentioned copending U.S. Patent Application, when a cloth previously woven of warp and weft yarns is embedded in a plate-like substrate sheet while molding the substrate sheet and hook elements, it is premised on that the characteristic of a surface fastener depends on the density of weave. Consequently various kinds of cloths having different weave densities have to be prepared. Because on some occasions users want a cloth resistant against only stretch and on other occasions they want a cloth resistant against only tear, it is not always necessary to give the cloth toughness in both warp and weft directions. The present inventors considered that using the cloth is inconvenient from an economical point of view and so as not to impair the characteristic of a surface fastener.

With continued consideration, the present inventors have found that as long as it does satisfy a particular molding condition, it is possible to embed a core sheet, such as a woven or knitted cloth, non-woven cloth, or a wire net, in the substrate sheet, simultaneously with the molding of the surface fastener, either according to the extrusion molding method disclosed in the above-mentioned U.S. Patent or according to the continuous injection molding method disclosed in the above-mentioned U.S. Patent Application. The present inventors have also found that it is advantageous to embed in the substrate sheet the core sheet as compared to the yarns.

According to a first aspect of this invention, there is provided a surface fastener molded of synthetic resin, comprising: a plate-like substrate sheet; a multiplicity of engaging elements standing from one surface of said plate-like substrate sheet; and a coarse mesh sheet molded by extrusion or continuous injection and integrally embedded in said plate-like substrate sheet over the substantially entire area eccentrically toward the one surface of the plate-like substrate sheet. If the coarse mesh sheet has a nap raised on its surface, part of the nap penetrates in the substrate sheet to increase the toughness of the hook elements remarkably so that the surface fastener is particularly advantageous when used as a fastener for industrial materials. If the core sheet is colored or patterned, such color or pattern is easy to see through the resin layer as it is embedded in the substrate sheet eccentrically to the hook-element-surface side, so that an artistic product can be obtained without using a highly transparent resin.

The core sheet must have adequate pores for the passage of molten resin. Usually, a molten resin pressure of 50–150 $kg/cm^2$ acts on the core sheet during the continuous injection. The size of the pores in the core sheet which allows the molten resin to smoothly pass through under this resin pressure is preferably at least 0.05 mm. A desired mesh size may be obtained by changing the weave density and/or woven structure if the core sheet is a woven cloth, the knit density and/or knit structure if it is a knitted cloth, the mesh if it is a wire net, and the fiber density if it is a non-woven cloth. The thickness of the core sheet is determined by the thickness of the substrate sheet of the surface fastener to be molded and its use; in view of easiness of molding, however, the core sheet thickness is preferably 20–60% of the substrate sheet. Accordingly, the size of yarns, wires or fibers of the core sheet may be determined optionally by the required thickness.

If the core sheet is composed of fibers and has a nap of a multiplicity of single-fiber on the surface, part of the nap penetrates in the hook elements molded on the substrate sheet surface; in this case, partly since adequate toughness of the substrate sheet is secured and partly since the hook elements have an improved degree of toughness as reinforced by fibers, the surface fastener is particularly suitable when used in industrial materials requiring a higher degree of toughness than conventional.

The surface fastener thus constructed is efficiently manufactured by the following methods.

According to a second aspect of the invention, a continuous injection molding method which comprises: driving the die wheel for one-way rotation; continuously injecting molten resin from a molten resin outlet of an injection die, which confronts the die wheel with a predetermined gap therebetween, by a predetermined width to the circumferential surface of the die wheel; continuously introducing the coarse mesh sheet into the gap between the die wheel and the molten resin outlet of the injection die to embed the coarse mesh sheet in the molten resin injected from the injection die and to fill the engaging-element cavities with part of the molten resin through the coarse mesh sheet to form the molded surface fastener; positively cooling the circumferential surface of the die wheel by a cooling means to cool the molded surface fastener; and continuously taking up the cooled molded surface fastener from the circumferential surface of the die wheel, for continuously manufacturing the molded surface fastener, which is composed of the plate-like substrate sheet and a multiplicity of engaging elements standing on a surface of the substrate sheet, on the circumferential surface of the die wheel having on its circumferential surface the engaging-element-forming cavities, is provided. Preferably, the cooling means is mounted in the die wheel so as to cool the circumferential surface of the die wheel. Further, the method may comprise the step of cooling part of the die wheel and the molded surface fastener travelling following the rotation of the die wheel in a cooling water tank by passing them through a cooling water tank simultaneously.

According to a third aspect of the invention, an extrusion molding method which comprises: rotating the die wheel and a pressure roller, which faces the die wheel with a predetermined gap therebetween, in opposite directions; continuously extruding molten resin from an extrusion nozzle to the gap between the die wheel and the pressure roller; continuously introducing a coarse mesh sheet into a gap between the die wheel and the molten resin extruded from the extrusion nozzle, to embed the coarse mesh sheet in the molten resin and to fill the engaging-element-forming cavities with part of the molten resin through the coarse mesh sheet to form the molded surface fastener; positively cooling the circumferential surface of the die wheel by a cooling means to cool the molded surface fastener; and continuously taking up the cooled molded surface fastener from the circumferential surface of the die wheel, for molding a surface fastener having a structure as described above. Preferably, the cooling means is mounted in the die wheel so as to cool the die wheel and the molded surface fastener on the circumferential surface of the die wheel are cooled by a cooler mounted in the die wheel. Further, the molded surface fastener may be cooled by blowing cooling air over the circumferential surface of the die wheel.

The important point to manufacture the surface fastener of this invention is that the core sheet having pores for passage of the molten resin is introduced between the die wheel and the molten resin continuously injected from the injection die or extruded from the extrusion nozzle. Namely, although the molten resin is not yet in direct contact with the circumferential surface of the die wheel while the core sheet is introduced, part of the molten resin is passed through the pores of the core sheet, under the resin pressure or by the pressing force of the press roller during extrusion, to reach the circumferential surface of the die wheel immediately after introduction. At that time, the core sheet is forced against the circumferential surface of the die wheel under the resin pressure or by the pressing force of the press roller. Accordingly, the core sheet is embedded in the substrate sheet, which molded between the injection die, or the press roller, and the die wheel, necessarily eccentrically to the die wheel side.

Part of the molten resin passed through the core sheet is filled in the hook-element-forming cavities of the die wheel to form the hook elements, and part of the molten resin passed through the core sheet fills the gap between the circumferential surface of the die wheel and the core sheet to fuse with the molten resin on the back-surface or hook-element-free side and the components of the core sheet to form the substrate sheet. The thickness of the thus molded substrate sheet is determined by the gap between the injection die and the die wheel in the case of continuous injection molding or by the gap between the die wheel and the press roller in the case of extrusion molding.

The core sheet embedded in the substrate sheet eccentrically to the hook-element-surface side serves to assist in peeling the molded surface fastener off the die wheel. Namely, because the core sheet exists in the substrate sheet eccentrically toward the hook-element-surface side, the die-wheel side of the substrate sheet is less extendible than the back-surface or hook-element-free side and is highly resistant against pull. Therefore, the pulling force acts effectively on the molded hook elements in the circumferential cavities of the die wheel so that the molded hook elements can be pulled out of the cavities without difficulty. Since the hook-element-side surface of the substrate sheet is not very extended, there occurs no difference in extension between the front and back sides of the substrate sheet so that the surface fastener does not become curved in one direction after molding and the hook elements are distributed uniformly, thus a high-quality surface fastener which is uniform in engaging strength is produced.

DETAILED DESCRIPTION OF THE PREFERRED EMBODIMENTS

Preferred embodiments of this invention will now be described in detail with reference to the accompanying drawings.

Figure 1:
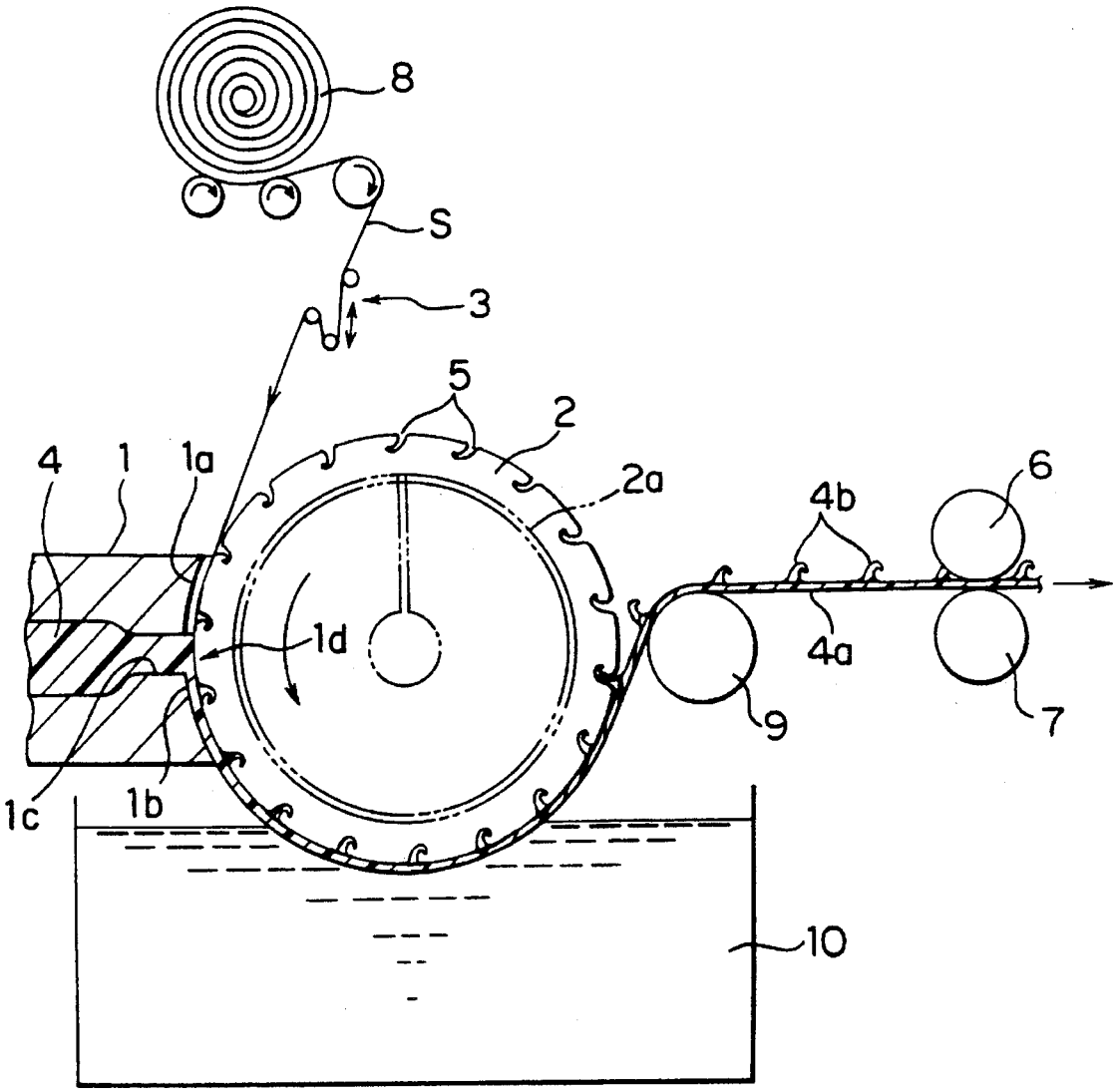
FIG. 1 is a fragmentary vertical cross-sectional view of a molded surface fastener manufacturing apparatus for carrying out a first embodiment of this invention.

FIG. 1 is a fragmentary vertical cross-sectional view showing the manner in which a molded surface fastener is manufactured by a continuous injection molding method according to a first embodiment of this invention. In this embodiment, engaging elements to be molded on a plate-like substrate sheet are hook elements.

In FIG. 1, reference numeral 1 designates an injection die. An upper half surface of the distal end of the injection die is an arcuate surface 1*a* substantially equal in curvature to a below-described die wheel 2, and a lower half surface is an arcuate surface 1*b* having such a curvature as to define a predetermined gap with respect to the curved surface of the die wheel 2. The injection die 1 is a T-shape die having a resin extrusion outlet 1*d* which is situated centrally of the upper and lower arcuate surfaces 1*a*, 1*b* and from which molten resin 4 is to be extruded in a sheet form under a predetermined molten resin pressure. In this embodiment, the injection die 1 has a single molten resin runner 1*c* centrally.

The die wheel 2 has a circumferential surface partially adjacent to the upper arcuate surface 1*a* of the injection die 1 and is spaced from the lower arcuate surface 1*b* by a predetermined gap, with its axis parallel to the extrusion outlet 1*d* of the injection die 1. According to the illustrated example, a multiplicity of hook-element-forming cavities 5 are formed on the circumferential surface of the die wheel 2. The structure of the die wheel 2 is substantially identical with the structure disclosed in U.S. Pat. No. 4,775,310 and is hence described here only in brief. The die wheel 2 is in the form of a hollow drum having a water cooling jacket 2*a*, and along the axis of the hollow drum a multiplicity of mold disks and a multiplicity of spacer plates are laminated alternately. Each of the mold disks has on front and back side peripheral edges a multiplicity of hook-element-forming cavities 5 with their bases opening to the circumferential surface of the mold disk. Each of the spacer plates has on both of front and back sides flat surfaces. The die wheel 2 is driven, by a non-illustrated known synchronous drive unit, to rotate in a direction indicated by an arrow.

A core sheet S drawn from a roll is introduced between the upper arcuate surface 1*a* of the injection die 1 and the circumferential surface of the die wheel 2 via a tension adjuster 3 after contacting part of the circumferential surface of the die wheel 2. In this embodiment, a cooling water tank 10 is situated under the die wheel 2 whose lower portion is soaked in the cooling water tank 10. A guide roller 9 is situated diagonally upwardly in front of the cooling water tank 10, and a set of upper and lower take-up rollers 6, 7 rotating at a speed slightly higher than the rotating speed of the die wheel 2 are situated forwardly of the guide roller 9.

The core sheet S to be used in this invention may be a coarse mesh woven fiber cloth, a coarse mesh knitted fiber cloth, a wire net with a predetermined mesh, a non-woven cloth with great porosity or a synthetic resin film with a multiplicity of pores in a predetermined pattern. In the case of fiber core sheet, fiber is made of thermoplastic resin such as nylon, polyester and polypropylene. Although the thermoplastic synthetic resin for the surface fastener and fiber materials are preferably the same, they may be different. The size of the fibers, fiber yarns or metal wires of the core sheet is determined by the required thickness of the core sheet.

Further, the thickness of the core sheet, which is determined depending on the thickness of the substrate sheet 4*a* of the surface fastener, is usually preferably 20–60% of the thickness of the substrate sheet 4*a*. In compliance with the resin material to be used, the molten resin temperature, molten resin pressure, die wheel temperature and rotational speed of the die wheel are adjusted as a matter of course. The required molten resin pressure is usually in the range of 50–150 km/cm$^2$, preferably 80–110 kg/cm$^2$.

For molding the surface fastener of this invention on the apparatus, the molten resin 4 to be continuously injected from the injection die 1 at a predetermined molten resin pressure is continuously forced into the gap between the injection die 1 and the rotating die wheel 2. At the same time, part of the molten resin is extruded onto the circumferential surface of the die wheel 2 via the pores of the core sheet S introduced into the above-mentioned gap along the circumferential surface of the die wheel 2 so that the molten resin 4 is filled in the hook-element-forming cavities 5 successively to form hook elements 4*b* as the molten resin 4 is expanded uniformly over the circumferential surface of the die wheel 2. As a result, the molten resin remaining on the injection outlet 1*d* of the injection die 1 and the expanded molten resin 4 are fused with the component material of the core sheet S to form the substrate sheet 4*a* having a predetermined thickness.

Figure 2:
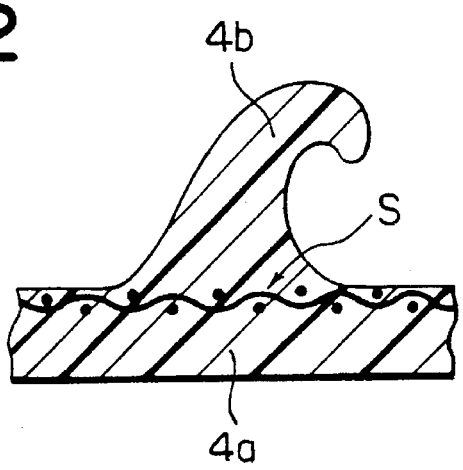
FIG. 2 is a fragmentary, enlarged cross-sectional view of the surface fastener manufactured by the first embodiment.

During this molding, the core sheet S keeps travelling around the circumferential surface of the die wheel 2 as it is forced thereagainst under the molten resin pressure. Therefore, in the manufacturing method of this invention, it is unnecessary to intentionally force the core sheet S against the circumferential surface of the die wheel 2 while introducing. Namely, merely by introducing the core sheet S into the above-mentioned gap with a tension enough to avoid slack, the core sheet S is necessarily forced against the circumferential surface of the die wheel 2 so that the core sheet S is embedded in the substrate sheet 4*a* of the molded surface fastener eccentrically to the hook-element-surface side or front-surface side as shown in FIG. 2. It is therefore unnecessary to use a complicated device for precise control and for traverse width control, which are used in copending U.S. patent application, Ser. No. 08/359,895. As a tension adjusting section 3, a simple tension controller, such as a dancer roller, enough to keep the core sheet free of slack suffices. As a matter of course, a precise tension adjustment may be made on the core sheet, if necessary.

Figure 3:
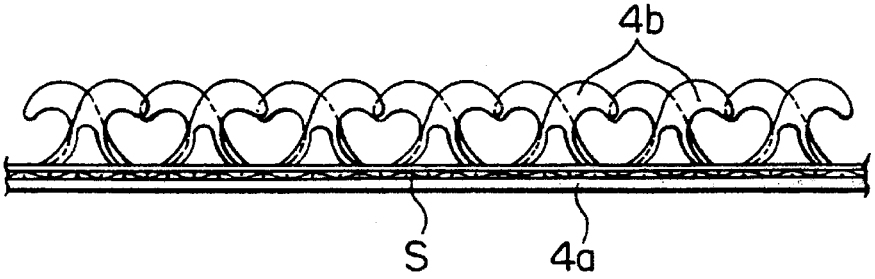
FIG. 3 is a cross-sectional view showing the entire molded surface fastener.
Figure 4:
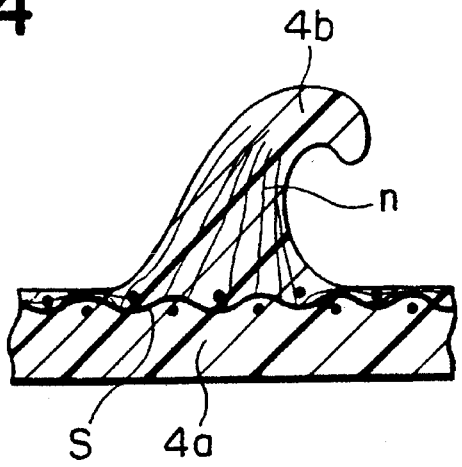
FIG. 4 is an enlarged cross-sectional view of an example of molded surface fastener in which a core sheet of the surface fastener has a nap on only one surface.

The molten resin 4 shaped into the surface fastener on the circumferential surface of die wheel 2 travels around substantially a half of the circumferential surface of the die wheel 2 as guided by the guide roller 9. During that time, the molten resin 4 is cooled from the inside of the die wheel 2 and is further cooled while passing through the cooling water tank 10 so that the substrate sheet 4*a*, in which the core sheet S is embedded, and the hook elements becomes gradually hard. When the substrate sheet 4*a* is positively taken up horizontally by the take-up rollers 6, 7 during this hardening, as the core sheet S is embedded in the substrate sheet 4*a* eccentrically to the hook-element-surface side, the core-sheet-embedded-side surface of the substrate sheet 4*a* does not extend even if it is pulled away from the circumferential surface of the die wheel 2, so that the front and back surfaces of the substrate sheet 4*a* have no difference of extension, thereby making the surface fastener free from curving in one direction after removed from the die wheel 2. Accordingly, a uniform density of hook elements which brings the uniform engaging strength can be achieved over the entire surface of the surface fastener, and the individual hook elements 4*a* can be pulled out of the cavities 5 smoothly as they resiliently deform. Immediately after being removed off the die wheel 2, the hook elements 4*b* restore its original shape to become hard completely and, as a result, the surface fastener having the shape shown in FIG. 3 is molded.

In this embodiment, in order to peel the molded resin product (i.e. the surface fastener with the core sheet embedded in the substrate sheet) off the die wheel 2, the upper and lower take-up rollers 6, 7 synchronously rotating in opposite directions are used. The circumferential surfaces of these take-up rollers 6, 7 may be smooth, but preferably, they may have circumferential grooves for receiving the hook elements 4*a* so as not to damage them. The rotational speed of the take-up rollers 6, 7 is slightly higher than the rotational speed of the die wheel 2 so that the hook elements 4*b* can be removed smoothly off the hook-element-forming cavities 5.

In the thus manufactured surface fastener, since the core sheet S is embedded in the substrate sheet 4*a* eccentrically to the hook-element-surface side, it is possible to give the substrate sheet 4*a* adequate toughness both longitudinally and transversely so that uniform-quality products can be obtained as mentioned above. In the resulting surface fastener, no stretch occurs during cutting under tension, and no breakage of a sewing needle occurs during sewing.

In case the core sheet S is made of fiber and it has a nap n raised on its surface, part of the nap n penetrates the hook elements to increase the toughness of the hook elements remarkably so that the surface fastener of this invention is particularly advantageous when used as a fastener for industrial materials. Further, if the core sheet S is colored or patterned, such color or pattern is easy to see through the resin layer as it is embedded in the substrate sheet eccentrically to the hook-element-surface side, so that an artistic product can be obtained without using a highly transparent resin. If the core sheet is made of wire net, a static discharge effect can be expected as the wire net is embedded in the substrate sheet 4*a* near to the hook-element-side surface. In such an event, magnetic attractivity also is increased if the companion engaging elements are made of magnetic material. Further, with the wire net embedded in the substrate sheet 4*a*, electromagnetic wave can be cut off, and moreover, it is also possible to deform the surface fastener and maintain its shape.

Figure 5:
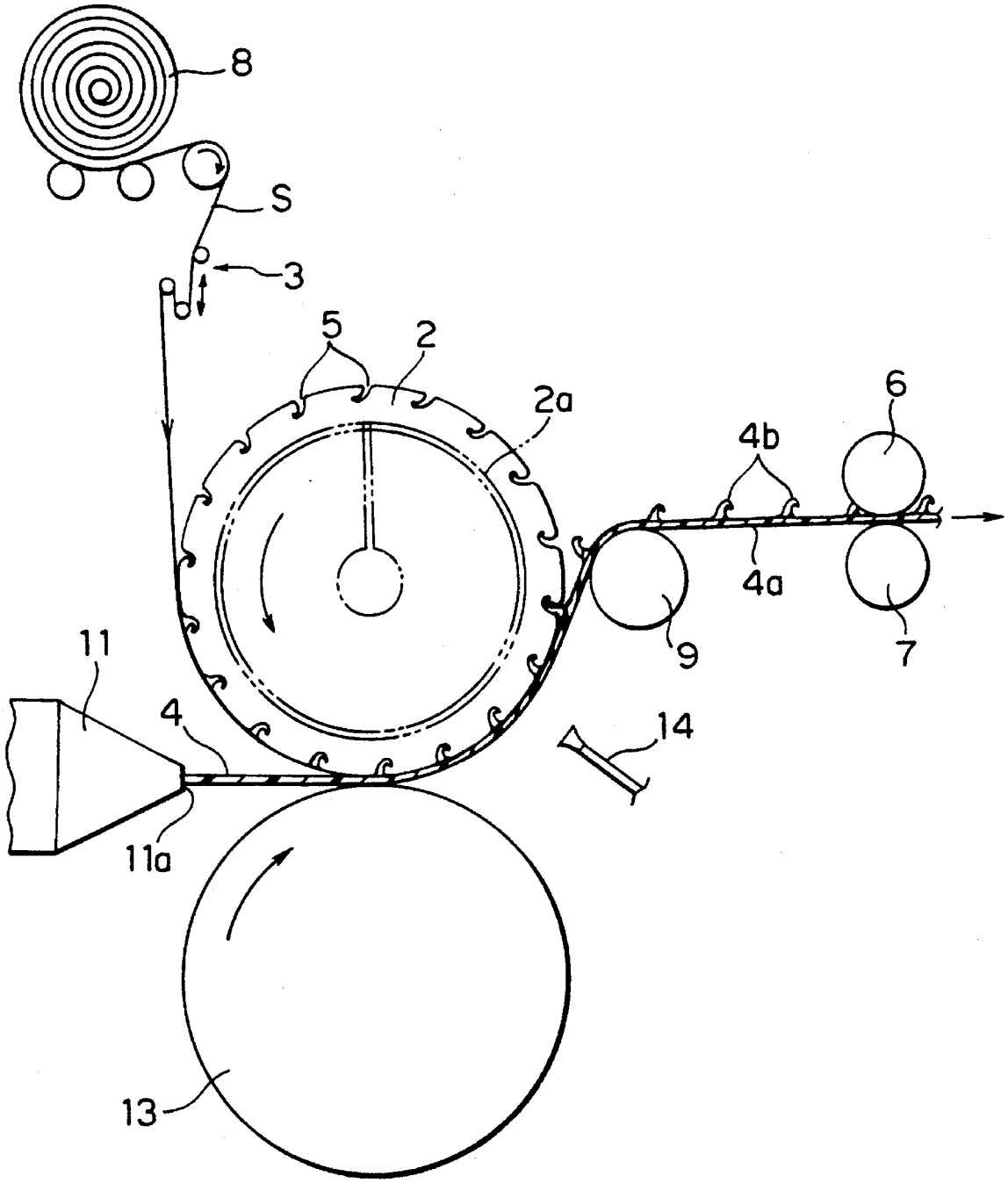
FIG. 5 is a fragmentary vertical cross-sectional view of a molded surface fastener manufacturing apparatus for carrying out a second embodiment of this invention.

FIG. 5 is a vertical cross-sectional view of an apparatus for manufacturing a surface fastener of a second embodiment of this invention by extrusion molding.

In the second embodiment, an extrusion nozzle 11 is used to substitute for the injection die 1, and a press roller 13 is situated under the die wheel 2 with a predetermined gap. A molten resin extrusion outlet 11*a* of the extrusion nozzle 11 is situated to face the gap between the die wheel 2 and the press roller 13. These three members are substantially identical in structure with those disclosed in U.S. Pat. No. 5,260,015, and their detailed description is omitted here.

In this embodiment, the most important point is that the core sheet S is introduced into the gap between the circumferential surface of the die wheel 2 and the molten resin 4 extruded from the extrusion nozzle 11. Namely, in the illustrated example, the core sheet S drawn from a roll 8 is introduced between the circumferential surface of the die wheel 2 and the molten resin 4, which is extruded from the molten resin extrusion outlet 11*a* of the extrusion nozzle 11, via the tension adjusting section 3 after partially contacting the circumferential surface of the die wheel 2. Further, a cooling water jacket 2*a* for cooling the circumferential surface of the die wheel 2 from the inside is situated in the die wheel 2, and a cooling air blower 14 is situated for blowing cooling air to the circumferential surface of the die wheel 2 having passed the pressing surface of the press roller 13. The die wheel 2 and the press roller 13 are driven, by a non-illustrated drive unit, to synchronously rotate in opposite directions as indicated by an arrow in FIG. 5.

A guide roller 9 is situated diagonally upwardly of the cooling air blower 14, and a set of upper and lower take-up rollers 6, 7 rotating at a speed slightly higher than the rotational speed of the die wheel 2 are situated forwardly of the guide roller 9.

According to the thus constructed apparatus, the molten resin 4 extruded from the extrusion nozzle 11 is introduced to the gap between the press roller 13 and the core sheet S, which is introduced along the circumferential surface of the die wheel 2, to be forced through the pores of the core sheet 5 to the circumferential surface of the die wheel 2 by the pressing force of the press roller 13. Part of the extruded molten resin 4 is filled in the hook-element-forming cavities 5 of the circumferential surface of the die wheel 2 to form the hook elements **4*b*, and at the same time, part of the extruded molten resin 4 is distributed between the die wheel 2 and the core sheet S so that the molten resin 4 on the hook-element-surface side of the core sheet S and the molten resin 4 on the backsurface side are fused together over the entire area to form the substrate sheet 4*a*. The thus molded surface fastener of this invention travels along substantially a quarter of the die wheel 2 and is then continuously removed off the circumferential surface of the die wheel 2 as positively taken up by the take-up rollers 6, 7 via the guide roller 9. Meanwhile, the molded surface fastener is gradually cooled by the cooling water jacket 2*a* in the die wheel 2 and is further cooled by air blown from the cooling air blower 14, thus becoming hard. In this embodiment, the core sheet S to be introduced to the gap between die wheel 2 and the press roller 13 is previously heated to eliminate any difference in temperature from the semimolten high-temperature substrate sheet 4*a*** so that their fusion can be more reliable.

In the first and second embodiments, the individual hook element **4*b* has a reinforcing rib 4*c* on each of opposite side surfaces as shown in FIG. 3. The individual hook, elements 4*b* are oriented in a common direction in the same row and are oriented in opposite directions in adjacent rows. The reinforcing ribs 4*c*, which may be omitted, are effective in preventing the hook elements 4*b* from falling sideways. In this invention, adjacent hook elements 4*b*** in the same row may be oriented alternately in opposite directions. With this arrangement, a surface fastener which is not directional in engaging force can be obtained. This invention should by no means be limited to the foregoing embodiments and various modifications may be suggested without departing from the gist of this invention.

As is apparent from the foregoing detailed description, according to the method of this invention, it is possible to continuously manufacture a molded surface fastener in which the core sheet S is embedded in the substrate sheet **4*a* eccentrically to the hook-element-surface side in a single molding step rather than in a plurality of meticulous molding steps, and the obtained surface fastener can secure adequate toughness in the longitudinal and transverse directions simultaneously. Further, during the molding, there is no extension difference between the front and back surfaces of the substrate sheet 4*a* when the surface fastener is peeled off the circumferential surface of the die wheel 2, and therefore the density of hook elements 4*b*** would be uniform over the entire area so that high-quality products excellent in size precision and having a uniform engaging strength can be achieved.

If the core sheet S is colored or patterned, such a pattern or color can be seen through clearly as the core sheet S exists in the substrate sheet **4*a* eccentrically to the front-surface side, without using a highly transparent material as the molding resin 4. If the core sheet S has the nap n raised on at least the front surface, the toughness of the hook elements 4*b* can be increased remarkably as part of the nap n penetrates the hook elements 4*b*** and is fused therewith, thus making the surface fastener most suitable for an industrial material fastener.

What is claimed is:

1. A surface fastener molded of synthetic resin, comprising:

a plate-shaped substrate sheet;

a multiplicity of engaging elements standing from one surface of said plate-like substrate sheet molded by extrusion or continuous injection with said plate-shaped substrate sheet; and a coarse mesh sheet integrally embedded in said plate-shaped substrate sheet during molding thereof across a width and length of the plate-shaped substrate sheet and closer to said one surface of said plate-shaped substrate sheet.

2. A molded surface fastener according to claim 1, wherein said coarse mesh sheet is a knitted or woven sheet.

3. A molded surface fastener according to claim 1, wherein said coarse mesh sheet is a non-woven cloth.

4. A molded surface fastener according to claim 1, wherein said coarse mesh sheet is a wire net.

5. A molded surface fastener according to claim 1, wherein said coarse mesh sheet has a nap raised on its surface and partly penetrating said engaging elements.

6. A molded surface fastener according to claim 1, wherein said coarse mesh sheet is colored and/or patterned.

7. A method for continuously manufacturing a molded surface fastener, which is composed of a plate-shaped substrate sheet and a multiplicity of engaging elements standing on a surface of the substrate sheet, on a circumferential surface of a die wheel having on its circumferential surface a multiplicity of engaging-element-forming cavities, said method comprising the steps of:

driving the die wheel for one-way rotation;

continuously injecting molten resin from a molten resin outlet of an injection die, which confronts the die wheel with a selected gap therebetween, across a selected width and applied to the circumferential surface of the die wheel, said gap defining a thickness of a plate-shaped substrate sheet;

continuously introducing a coarse mesh sheet into said gap between the die wheel and the molten resin outlet of the injection die to embed the coarse mesh sheet in the molten resin injected from the injection die and to fill the engaging-element cavities with part of the molten resin through the coarse mesh sheet to form the molded surface fastener, said coarse mesh sheet held close to the circumferential surface of the die wheel to be molded within said substrate sheet closer to the circumferential surface of the die wheel than to an outside surface of said substrate sheet;

positively cooling the circumferential surface of the die wheel by a cooling means to cool the molded surface fastener; and continuously removing the cooled molded surface fastener from the circumferential surface of the die wheel.

8. A molded surface fastener manufacturing method according to claim 7, wherein said cooling means is mounted in the die wheel so as to cool the circumferential surface of the die wheel.

9. A molded surface fastener manufacturing method according to claim 7, further comprising the step of cooling part of the die wheel and the surface fastener traveling following the rotation of the die wheel in a cooling water tank as they pass simultaneously through said tank.

10. A method for continuously manufacturing a molded surface fastener, which is composed of a plate-shaped substrate sheet and a multiplicity of engaging elements standing on a surface of the plate-shaped substrate sheet, on a circumferential surface of a die wheel having on its circumferential surface a multiplicity of engaging-element-forming cavities, said method comprising the steps of:

rotating the die wheel and a pressure roller, which faces the die wheel with a selected gap therebetween, in opposite direction;

continuously extruding molten resin from an extrusion nozzle to the gap between the die wheel and the pressure roller, said gap defining a thickness of a plate-shaped substrate sheet;

continuously introducing a coarse mesh sheet into a gap between the die wheel and the molten resin extruded from the extrusion nozzle, to embed the coarse mesh sheet in the molten resin and to fill the engaging-element-forming cavities with part of the molten resin through the coarse mesh sheet to form the molded surface fastener, said coarse mesh sheet held close to the circumferential surface of the die wheel to be molded within said substrate sheet closer to the circumferential surface of the die wheel than to an outside surface of said substrate sheet;

positively cooling the circumferential surface of the die wheel by a cooling means to cool the molded surface fastener; and continuously removing the cooled molded surface fastener from the circumferential surface of the die wheel.

11. A molded surface fastener manufacturing method according to claim 10, wherein said cooling means is mounted in the die wheel so as to cool the circumferential surface of the die wheel.

* * * * *